US008703371B2

(12) United States Patent
Kitamura et al.

(10) Patent No.: US 8,703,371 B2
(45) Date of Patent: Apr. 22, 2014

(54) ELECTROPHOTOGRAPHIC PHOTOSENSITIVE MEMBER, METHOD FOR PRODUCING THE SAME, PROCESS CARTRIDGE, AND ELECTROPHOTOGRAPHIC APPARATUS

(75) Inventors: Wataru Kitamura, Numazu (JP); Kenichi Kaku, Suntou-gun (JP); Mai Murakami, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 13/285,242

(22) Filed: Oct. 31, 2011

(65) Prior Publication Data

US 2012/0115076 A1 May 10, 2012

(30) Foreign Application Priority Data

Nov. 4, 2010 (JP) ..... 2010-247863
Oct. 14, 2011 (JP) ..... 2011-227037

(51) Int. Cl.
*G03G 5/047* (2006.01)
*G03G 5/06* (2006.01)

(52) U.S. Cl.
CPC ..... *G03G 5/0609* (2013.01)
USPC ..... 430/59.4; 430/59.1; 430/96; 399/159; 399/111

(58) Field of Classification Search
USPC ..... 430/59.1, 59.4, 96; 399/111, 159
See application file for complete search history.

(56) References Cited

U.S. PATENT DOCUMENTS

| | | | | |
|---|---|---|---|---|
| 5,153,085 | A | 10/1992 | Akasaki | |
| 2004/0137346 | A1 | 7/2004 | Lee | |
| 2005/0142472 | A1 * | 6/2005 | Sekido et al. | 430/58.05 |

FOREIGN PATENT DOCUMENTS

| | | | |
|---|---|---|---|
| EP | 0785477 | A2 | 7/1997 |
| EP | 785477 | A2 * | 7/1997 |
| JP | 2-97961 | | 4/1990 |

* cited by examiner

*Primary Examiner* — Christopher Rodee
(74) *Attorney, Agent, or Firm* — Canon U.S.A., Inc., IP Division

(57) ABSTRACT

A charge generating layer of an electrophotographic photosensitive member contains a charge generating substance, polyvinyl acetal, and a fluorenone derivative.

8 Claims, 1 Drawing Sheet

ELECTROPHOTOGRAPHIC PHOTOSENSITIVE MEMBER, METHOD FOR PRODUCING THE SAME, PROCESS CARTRIDGE, AND ELECTROPHOTOGRAPHIC APPARATUS

BACKGROUND OF THE INVENTION

1. Field of the Invention

The present invention relates to an electrophotographic photosensitive member and a method for producing the electrophotographic photosensitive member, and to a process cartridge and an electrophotographic apparatus including the electrophotographic photosensitive member.

2. Description of the Related Art

In recent years, electrophotographic photosensitive members (organic electrophotographic photosensitive members) including a charge generating layer that contains a charge generating substance and a charge transporting layer that contains a charge transporting substance have been used as electrophotographic photosensitive members used for electrophotographic apparatuses.

The potential characteristics (chargeability and sensitivity) of the electrophotographic photosensitive member depend on the types of materials used for the charge generating layer and the charge transporting layer. Thus, the potential characteristics of the electrophotographic photosensitive member can be improved by changing the structures and combination of the above-described materials.

With a recent increase in the processing speed of electrophotographic apparatuses, in addition to the improvement in potential characteristics such as increases in chargeability and sensitivity, the potential variation (changes in chargeability and sensitivity) after repeated use needs to be further suppressed. Specifically, the potential variations (changes in chargeability and sensitivity) in terms of (1) and (2) below need to be further suppressed:

(1) Long-term repeated use from the initial use of an electrophotographic photosensitive member to the end of the life of the electrophotographic photosensitive member; and (2) Relatively short-term repeated use (e.g., from the first image output to the completion of about 1000 continuous outputs).

In terms of (1) above, the potential variation may be increased depending on the configuration of the electrophotographic photosensitive member (the potential characteristics may be significantly degraded). In such a case, even if the electrophotographic photosensitive member is left to stand after long-term repeated use, the potential characteristics do not return to the original level, which means low recoverability.

In the case where the potential variation is large in terms of (2) above, for example, the color of an image formed on the first output sheet sometimes becomes different from that of an image formed on the 1000th output sheet. However, in such a short-term potential variation, the potential characteristics easily return to the original level within a relatively short time by leaving the electrophotographic photosensitive member.

It is believed that the potential variation of (1) is caused by accumulating the potential variations of (2) that are not recovered within a short time even if the electrophotographic photosensitive member is left to stand.

It is important to suppress the potential variations of (1) and (2) above and thus allow an electrophotographic photosensitive member to always stably output an image. In particular, the potential variation of (2) above is problematic, and the change in color needs to be small in any circumstances.

In other words, the potential variation of (2) above at the beginning of use of an electrophotographic photosensitive member needs to be suppressed, or the potential variation of (2) above after the long-term repeated use of the electrophotographic photosensitive member needs to be suppressed.

Japanese Patent Laid-Open No. 2-97961 discloses a technology that suppresses a potential variation by adding a certain fluorenone compound to the charge generating layer of an electrophotographic photosensitive member. However, Japanese Patent Laid-Open No. 2-97961 does not focus on the potential variation of (2) above.

In fact, the electrophotographic photosensitive member disclosed in Japanese Patent Laid-Open No. 2-97961 had a small potential variation of (2) when used for a short time at the beginning of use of the electrophotographic photosensitive member. However, when a short-term potential variation ((2) above) after the long-term repeated use ((1) above) of the electrophotographic photosensitive member was measured, the potential variation was increased compared with the initially measured potential variation.

Regardless of the degree of potential variation after long-term repeated use, the short-term potential variation after the long-term repeated use was increased compared with the initially measured short-term potential variation.

The fluorenone compound disclosed in Japanese Patent Laid-Open No. 2-97961 easily caused spot-like image defects on an output image when used for a charge generating layer containing polyvinyl acetal as a binder resin. This phenomenon also occurred considerably when a charge-generating-layer coating solution was stored in a high-temperature environment.

SUMMARY OF THE INVENTION

Aspects of the present invention provide an electrophotographic photosensitive member in which spot-like image defects are not easily caused and the short-term potential variation is suppressed even after the long-term repeated use, and a method for producing the electrophotographic photosensitive member.

Aspects of the present invention also provide a process cartridge and an electrophotographic apparatus including the electrophotographic photosensitive member.

According to an aspect of the invention, the electrophotographic photosensitive member includes a support; and a charge generating layer and a charge transporting layer formed on the support, wherein the charge generating layer includes a charge generating substance, polyvinyl acetal, and a compound represented by the general formula (1) below.

(1)

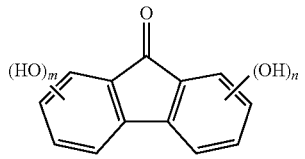

In the general formula (1), m is an integer selected from 0 to 4 and n is an integer selected from 1 to 4.

According to another aspect of the invention, a method is provided for producing an electrophotographic photosensitive member having a support; and a charge generating layer and a charge transporting layer formed on the support, the method including a step of forming the charge generating layer with a charge-generating-layer coating solution having a charge generating substance, polyvinyl acetal, and a compound represented by the general formula (1) above.

According to another aspect of the invention, a process cartridge that is detachably mountable to a main body of an electrophotographic apparatus is provided, the process cartridge including the above-described electrophotographic photosensitive member; and at least one unit selected from the group of a charging unit, a developing unit, a transferring unit, and a cleaning unit, wherein the process cartridge integrally supports the electrophotographic photosensitive member and the at least one unit.

According to one aspect, the electrophotographic apparatus includes the above-described electrophotographic photosensitive member, a charging unit, an exposing unit, a developing unit, and a transferring unit.

According to aspects of the present invention, there can be provided an electrophotographic photosensitive member in which spot-like image defects are not easily caused and the short-term potential variation is suppressed even after the long-term repeated use, and a method for producing the electrophotographic photosensitive member.

According to aspects of the present invention, there can also be provided a process cartridge and an electrophotographic apparatus including the electrophotographic photosensitive member.

Further features of the present invention will become apparent from the following description of exemplary embodiments with reference to the attached drawings.

DESCRIPTION OF THE EMBODIMENTS

In an aspect of the present invention, a charge generating layer of an electrophotographic photosensitive member includes a charge generating substance, polyvinyl acetal, and a compound (fluorenone derivative) represented by the general formula (1) below.

(1)

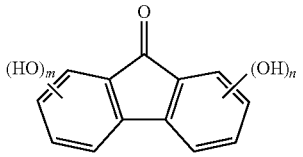

In the general formula (1), m is an integer selected from 0 to 4 and n is an integer selected from 1 to 4.

The inventors of the present invention consider that a mechanism with which spot-like image defects are suppressed by adding the compound represented by the general formula (1) to the charge generating layer may be as follows.

The compound represented by the general formula (1) is a compound having only a hydroxyl group as a substituent that bonds to the benzene ring of fluorenone. Therefore, the compound is highly compatible with polyvinyl acetal and thus such compounds do not easily aggregate each other in a charge-generating-layer coating solution. As a result, spot-like image defects are suppressed.

Furthermore, the inventors of the present invention consider that a mechanism with which the short-term potential variation after the long-term repeated use is improved by adding the compound represented by the general formula (1) to the charge generating layer may be as follows.

The compound represented by the general formula (1) interacts with a charge generating substance, whereby an intramolecular charge-transfer complex is formed and the compound easily receives electrons. For example, the interaction makes the compound smoothly receive electrons from the charge generating substance.

Specific examples of the compound represented by the general formula (1) are shown below, but the aspects of the present invention are not limited thereto.

(1-1)

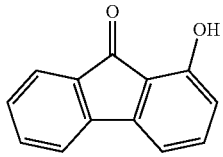

(1-2)

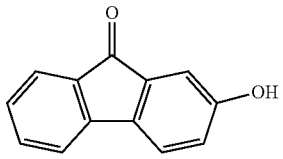

(1-3)

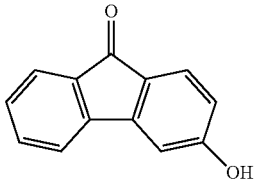

(1-4)

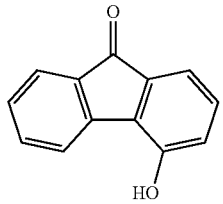

(1-5)

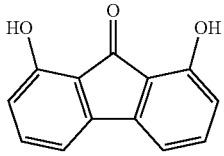

(1-6)

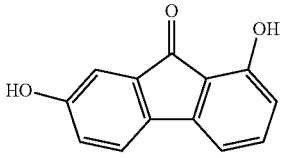

-continued (1-7)

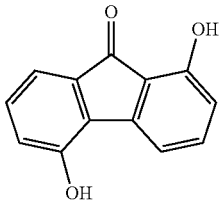

Among these compounds, the compounds (1-1) to (1-4) can be provided, and the compounds (1-1) and (1-2) can be particularly provided.

According to aspects of the present invention, the charge generating layer can contain the compound represented by the general formula (1) in an amount of 0.1% or more and 20% or less by mass relative to the amount of the charge generating substance. When the amount is 0.1% or more by mass, the effect of suppressing charge variation is increased, the effect being caused by the interaction between the compound and the charge generating substance. When the amount is 20% or less by mass, the interaction between the compounds is suppressed and thus the above-described effect is increased.

According to aspects of the present invention, a binder resin used for the charge generating layer is polyvinyl acetal. Even if the compound represented by the general formula (1) is used for the charge generating layer that uses polyvinyl acetal as a binder resin, the compound does not easily cause spot-like image defects.

Figure 2:
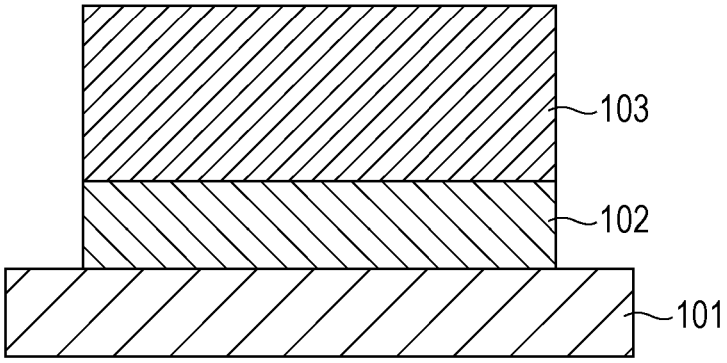
FIG. 2 shows an exemplary layer structure of the electrophotographic photosensitive member according to aspects of the present invention.

An electrophotographic photosensitive member according to aspects of the present invention includes a support and a charge generating layer and a charge transporting layer formed on the support. That is, the electrophotographic photosensitive member according to aspects of the present invention includes a laminated photosensitive layer whose function is separated into the charge generating layer and the charge transporting layer. The charge generating layer and the charge transporting layer can be formed on the support in that order. In FIG. 2, 101 denotes a support, 102 denotes a charge generating layer, and 103 denotes a charge transporting layer. A conductive layer and an intermediate layer described below can be formed between the support and the charge generating layer/charge transporting layer.

Any support may be used as long as it has conductivity (conductive support). For example, a support made of a metal such as aluminum or an alloy such as an aluminum alloy or stainless steel can be used. Alternatively, the above-described metal support or a plastic support having a layer formed by vacuum deposition using aluminum, an aluminum alloy, an indium oxide-tin oxide alloy, or the like can also be used. Other examples of the support include a support obtained by impregnating plastic or paper with conductive particles, such as carbon black, tin oxide particles, titanium oxide particles, or silver particles, together with an appropriate binder resin and a plastic support including a conductive binder resin. The support can have a cylindrical or belt-like shape, and a cylindrical shape may be more suitable.

The surface of the support may be subjected to cutting treatment, surface roughening treatment, or anodizing treatment to suppress interference fringes caused by scattering of laser beams.

A conductive layer may be formed between the support and the photosensitive layer (charge generating layer or charge transporting layer) or an intermediate layer described below to suppress interference fringes caused by scattering of laser beams and to cover scratches formed on the support. The conductive layer can be formed by dispersing conductive particles such as carbon black in a binder resin. The thickness of the conductive layer may be 5 to 40 μm, such as 10 to 30 μm.

An intermediate layer may be formed between the support or the conductive layer and the photosensitive layer (charge generating layer or charge transporting layer).

The intermediate layer can be formed by applying an intermediate layer coating solution obtained by dissolving a resin in a solvent and then by drying the resultant layer.

Examples of the resin used for the intermediate layer include acrylic resins, allyl resins, alkyd resins, ethyl cellulose resins, ethylene-acrylic acid copolymers, epoxy resins, casein resins, silicone resins, gelatin resins, phenol resins, butyral resins, polyacrylate, polyacetal, polyamide-imide, polyamide, polyalkyl ether, polyimide, polyurethane, polyester, polyethylene, polycarbonate, polystyrene, polysulfone, polyvinyl alcohol, polybutadiene, and polypropylene. These resins can be used alone, or in combination as a mixture or a copolymer.

Examples of the solvent used for the intermediate layer coating solution include alcohols, sulfoxides, ketones, ethers, esters, aliphatic halogenated hydrocarbons, and aromatic compounds.

The intermediate layer may optionally contain metal oxide particles, organic resin particles, or a leveling agent. Examples of the metal oxide particles include particles of titanium oxide, zinc oxide, tin oxide, zirconium oxide, and aluminum oxide. The metal oxide particles may be particles obtained by surface-treating a metal oxide with a surface-treating agent such as a silane coupling agent.

The thickness of the intermediate layer may be 0.5 to 20 μm, such as 0.6 to 5 μm.

The charge generating layer and the charge transporting layer are formed on the support, the conductive layer, or the intermediate layer.

Examples of the charge generating substance used for the charge generating layer include azo pigments such as monoazo, diazo, and trisazo pigments; phthalocyanine pigments such as metal phthalocyanines and non-metal phthalocyanines; indigo pigments such as indigo and thioindigo; perylene pigments such as perylene anhydrides and perylene imide; polycyclic quinone pigments such as anthraquinone, pyrenequinone, and dibenzpyrenequinone; squarylium dyes; pyrylium salts and thiapyrilium salts; triphenylmethane dyes; inorganic substances such as selenium, selenium-tellurium, and amorphous silicon; quinacridone pigments; azulenium salt pigments; cyanine dyes such as quinocyanine; anthanthrone pigments; pyranthrone pigments; xanthene dyes; quinoneimine dyes; styryl dyes; cadmium sulfide; and zinc oxide. These charge generating substances may be used alone or in combination.

Among these charge generating substances, in view of sensibility, phthalocyanine pigments and azo pigments may be provided, and phthalocyanine pigments may be particularly provided.

Among the phthalocyanine pigments, in particular, oxytitanium phthalocyanine, chlorogallium phthalocyanine, and hydroxygallium phthalocyanine exhibit high charge-generating efficiency.

Furthermore, in view of potential characteristics, a hydroxygallium phthalocyanine crystal having strong peaks at Bragg angles 2θ of 7.4°±0.3° and 28.2°±0.3° in the X-ray diffraction spectrum measured using a CuKα characteristic X-ray may be used among hydroxygallium phthalocyanines. In particular, a hydroxygallium phthalocyanine crystal having strong peaks at Bragg angles 2θ±0.2° of 7.4° and 28.1° in the X-ray diffraction spectrum measured using a CuKα characteristic X-ray may be used.

According to aspects of the present invention, an X-ray diffraction spectrum was measured using a CuKα characteristic X-ray under the following conditions.

Measuring instrument: Full-automatic X-ray diffraction apparatus MXP18 manufactured by MAC Science Co. Ltd.

X-ray tube: Cu
Tube voltage: 50 kV
Tube current: 300 mA
Scanning method: 2θ/θ scan
Scanning speed: 2 deg./min
Sampling interval: 0.020 deg.
Start angle (2θ): 5 deg.
Stop angle (2θ): 40 deg.
Divergence slit: 0.5 deg.
Scattering slit: 0.5 deg.
Receiving slit: 0.3 deg.
Curved monochromator: use The charge generating layer can be formed by applying a charge-generating-layer coating solution obtained by dispersing the charge generating substance together with polyvinyl acetal, the compound represented by the general formula (1), and a solvent, and then by drying the resultant layer. The dispersion can be performed by a method that uses, for example, a homogenizer, an ultrasonic disperser, a ball mill, a sand mill, a roll mill, a vibration mill, an attritor, or a liquid collision high speed disperser. The ratio of the charge generating substance to polyvinyl acetal can be 0.3:1 to 10:1 by mass.

The compound represented by the general formula (1) may be added after the charge generating substance, polyvinyl acetal, and the solvent, have been dispersed. However, the method in which the compound represented by the general formula (1), the charge generating substance, polyvinyl acetal, and the solvent are mixed with each other and then dispersion treatment is performed can be particularly employed because the compound represented by the general formula (1) is uniformly dispersed in the charge generating layer.

Examples of the solvent used for the charge-generating-layer coating solution include alcohols, sulfoxides, ketones, ethers, esters, aliphatic halogenated hydrocarbons, and aromatic compounds.

The thickness of the charge generating layer may be 5 μm or less, such as 0.1 μm or more and 2 μm or less. Various additives such as a sensitizer, an antioxidant, an ultraviolet absorber, and a plasticizer can be optionally added to the charge generating layer.

Examples of a charge transporting substance used for the charge transporting layer include triarylamine compounds, hydrazone compounds, styryl compounds, stilbene compounds, and butadiene compounds. Among these compounds, triarylamine compounds may be provided in view of achieving high mobility of charges.

Examples of the binder resin used for the charge transporting layer include acrylic resins, acrylonitrile resins, allyl resins, alkyd resins, epoxy resins, silicone resins, phenol resins, phenoxy resins, polyacrylamide, polyamide-imide, polyamide, polyalkyl ether, polyarylate, polyimide, polyurethane, polyester, polyethylene, polycarbonate, polysulfone, polyphenylene oxide, polybutadiene, polypropylene, and methacrylic resins. Polyarylate and polycarbonate can be particularly used. These binder resins can be used alone, or in combination as a mixture or a copolymer.

The charge transporting layer can be formed by applying a charge-transporting-layer coating solution obtained by dissolving the charge transporting substance and the binder resin in a solvent, and then by drying the resultant layer. The ratio of the charge transporting substance to the binder resin can be 0.3:1 to 10:1 by mass. The drying temperature may be 60° C. or higher and 150° C. or lower, such as 80° C. or higher and 120° C. or lower to suppress formation of cracks. The drying time may be 10 minutes or longer and 60 minutes or shorter.

Examples of the solvent used for the charge-transporting-layer coating solution include alcohols (particularly alcohols having 3 or more carbon atoms) such as propanol and butanol; aromatic hydrocarbons such as anisole, toluene, xylene, and chlorobenzene; and methylcyclohexane and ethylcyclohexane.

In the case where the charge transporting layer has a layered structure, a charge transporting layer on the surface side of the electrophotographic photosensitive member can be cured by polymerizing and/or cross-linking a charge transporting substance having a chain-polymerizable functional group to increase the mechanical strength of the electrophotographic photosensitive member. Examples of the chain-polymerizable functional group include an acrylic group, an alkoxysilyl group, and an epoxy group. To polymerize and/or cross-link the charge transporting substance having a chain-polymerizable functional group, heat, light, or radiation (e.g., electron beam) can be used.

In the case where the charge transporting layer of the electrophotographic photosensitive member has a single-layer structure, the thickness of the charge transporting layer may be 5 μm or more and 40 μm or less, such as 8 μm or more and 30 μm or less.

In the case where the charge transporting layer has a layered structure, the thickness of a charge transporting layer on the support side of the electrophotographic photosensitive member can be 5 μm or more and 30 μm or less, and the thickness of a charge transporting layer on the surface side of the electrophotographic photosensitive member can be 1 μm or more and 10 μm or less.

Various additives such as an antioxidant, an ultraviolet absorber, and a plasticizer can be optionally added to the charge transporting layer.

A protective layer may be formed on the photosensitive layer to protect the photosensitive layer. The protective layer can be formed by applying a protective layer coating solution obtained by dissolving the above-described binder resins in a solvent, and then by drying the resultant layer. Alternatively, the protective layer may be formed by applying a protective layer coating solution obtained by dissolving resin monomers or oligomers in a solvent, and then by curing and/or drying the resultant layer. Light, heat, or radiation (e.g., electron beam) can be used for the curing.

The thickness of the protective layer may be 0.5 μm or more and 10 μm or less, such as 1 μm or more and 7 μm or less. Conductive particles or the like can be optionally added to the protective layer.

The coating solution for each of the layers can be applied by dipping (dip coating), spray coating, spinner coating, roller coating, Meyer bar coating, blade coating, or the like.

A lubricant such as silicone oil, wax, polytetrafluoroethylene particles, silica particles, alumina particles, or boron nitride may be contained in the outermost layer (surface layer) of the electrophotographic photosensitive member.

Figure 1:
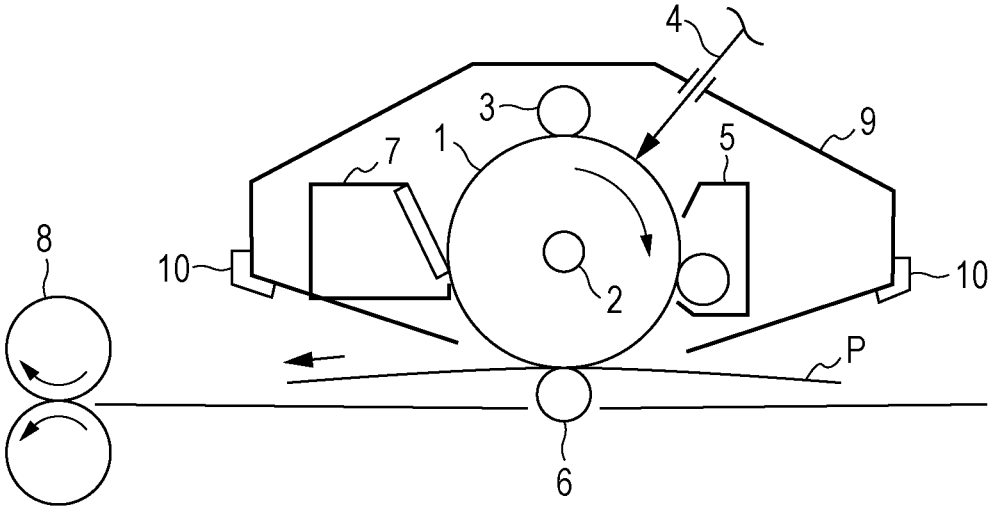
FIG. 1 schematically shows an exemplary structure of an electrophotographic apparatus having a process cartridge including an electrophotographic photosensitive member according to aspects of the present invention.

FIG. 1 shows a schematic structure of an electrophotographic apparatus having a process cartridge including the electrophotographic photosensitive member according to aspects of the present invention.

In FIG. 1, a cylindrical electrophotographic photosensitive member 1 according to aspects of the present invention is rotated about a shaft 2 at a predetermined peripheral speed (processing speed) in a direction indicated by an arrow. In the rotation, the surface of the electrophotographic photosensitive member 1 is uniformly charged at a predetermined positive or negative potential by a charging unit 3 (a first charging unit such as a charging roller). Next, the electrophotographic photosensitive member 1 is irradiated with exposure light 4, which is reflected light from an original, that is output from an exposing unit (not shown) providing slit exposure or laser beam scanning exposure and that is intensity-modulated in accordance with a time-series electrical digital pixel signal of intended image information. Thus, an electrostatic latent image corresponding to the intended image information is sequentially formed on the surface of the electrophotographic photosensitive member 1.

The electrostatic latent image formed on the surface of the electrophotographic photosensitive member 1 is developed with charged particles (toner) contained in a developer in a developing unit 5, by normal or reversal developing, and thus a toner image is formed. The toner image formed and carried on the surface of the electrophotographic photosensitive member 1 is then sequentially transferred onto a transfer medium P by a transferring bias from a transferring unit (e.g., transfer roller) 6. In this process, the transfer medium P is fed from a transfer medium feeding unit (not shown) to a portion (contact portion) between the electrophotographic photosensitive member 1 and the transferring unit 6 in synchronization with the rotation of the electrophotographic photosensitive member 1. In addition, a bias voltage having a polarity opposite to the charge polarity of the toner is applied to the transferring unit 6 from a bias power source (not shown).

In the case where the transfer medium P onto which the toner image has been transferred is a final transfer medium (paper, film, or the like), the transfer medium P is separated from the surface of the electrophotographic photosensitive member and conveyed to a fixing unit 8 where the toner image is subjected to a fixing process. After the fixing process, the transfer medium P is printed out as an image-formed matter (print or copy) to the outside of the electrophotographic apparatus. In the case where the transfer medium P is an intermediate transfer member, after a plurality of transfer steps, a fixing process is performed and a final transfer medium is printed out.

A deposition, such as the developer (toner) left on the surface of the electrophotographic photosensitive member 1 from which the toner image has been transferred to the transfer medium, is removed by a cleaning unit 7 (e.g., cleaning blade) to clean the surface of the electrophotographic photosensitive member 1. In recent years, a cleanerless system has been studied, and thus the toner left without being transferred can be directly collected by a developing unit or the like. Furthermore, the surface of the electrophotographic photosensitive member 1 is de-charged with pre-exposure light (not shown) from a pre-exposing unit (not shown), and is then repeatedly used for image formation. In the case where the charging unit 3 is a contact charging unit that uses a charging roller or the like as shown in FIG. 1, pre-exposure is not necessarily required.

According to aspects of the present invention, two or more of the components described above, such as the electrophotographic photosensitive member 1, the charging unit 3, the developing unit 5, and the cleaning unit 7, may be accommodated in a container and integrally combined together to constitute a process cartridge. The process cartridge may be detachably mountable to the main body of an electrophotographic apparatus such as a copying machine or a lager beam printer. For example, as least one selected from the charging unit 3, the developing unit 5, and the cleaning unit 7 can be integrally supported together with the electrophotographic photosensitive member 1 to constitute a process cartridge 9, which is detachably mountable to the main body of the electrophotographic apparatus with a guiding unit 10 such as a rail included in the main body of the electrophotographic apparatus.

In the case where the electrophotographic apparatus is a copying machine or a printer, the exposure light 4 is reflected light or transmitted light from an original. Alternatively, the exposure light 4 is light, applied by scanning with a laser beam according to signals into which an original read by a sensor is converted, or driving of an LED array or a liquid-crystal shutter array.

The electrophotographic photosensitive member according to aspects of the present invention can be generally applied to various electrophotographic apparatuses such as electrophotographic copying machines, laser beam printers, LED printers, FAX machines, and liquid-crystal shutter printers. Furthermore, the electrophotographic photosensitive member according to aspects of the present invention can be widely used for devices such as display, recording, near-print, plate making, and facsimile devices to which electrophotographic techniques are applied.

Aspects of the present invention will now be more specifically described based on Examples, but are not limited thereto. In Examples, the term "part(s)" refers to "part (s) by mass".

EXAMPLES

Example 1

An aluminum cylinder, which is a drawn tube having a diameter of 30 mm and a length of 357.5 mm, was used as a support.

Next, 50 parts of titanium oxide particles coated with tin oxide that contains 10% antimony oxide, 25 parts of resole phenolic resin, 20 parts of methyl cellosolve, 5 parts of methanol, and 0.002 parts of silicone oil (polydimethylsiloxane-polyoxyalkylene copolymer with an average molecular weight of 3000) were dispersed for 2 hours with a sand mill that uses glass beads having a diameter of 0.8 mm. Subsequently, 3.8 parts of silicone resin particles (product name: Tospearl 120 manufactured by Toshiba Silicone Co., Ltd.) were added thereto, and the mixture was stirred for 5 hours to prepare a conductive layer coating solution. The conductive layer coating solution was applied onto the aluminum cylinder (drawn tube having a diameter of 30 mm and a length of 357.5 mm) serving as a support by dip coating, and the resultant layer was dried at 140° C. for 30 minutes to form a conductive layer having a thickness of 20 μm.

Next, an intermediate layer coating solution was prepared by the method below.

The materials below were mixed with each other and then dispersed for 15 hours with a paint shaker that uses 60 parts of zirconium beads having a diameter of 0.3 mm to prepare an intermediate layer coating solution:

Metal oxide particles: 4 parts of titanium oxide particles (product name: TKP-101 manufactured by TAYCA Corporation);

Resin solution: 30.8 parts of a solution prepared by dissolving 10 parts of N-methoxymethylated 6-nylon (product name: Toresin EF-30T manufactured by Nagase ChemteX Corporation, methoxymethylation ratio: 28 to 33% by mass)

in 90 parts of methanol (in the solution, the content of N-methoxymethylated 6-nylon was 3.08 parts and 77% by mass relative to that of the metal oxide particles); and Solvent: 14 parts of 1-butanol.

The intermediate layer coating solution was applied onto the conductive layer by dip coating, and the resultant layer was dried at 100° C. for 10 minutes to form an intermediate layer having a thickness of 1.2 μm.

Subsequently, 4 parts of a hydroxygallium phthalocyanine crystal (charge generating substance) having strong peaks at Bragg angles 2θ±0.2° of 7.4° and 28.1° in the X-ray diffraction spectrum measured using a CuKα characteristic X-ray, 0.04 parts of a compound represented by the formula (A) below, and 0.004 parts of the compound (0.1% by mass relative to the charge generating substance) represented by the structural formula (1-1) were added to a solution obtained by dissolving 2 parts of polyvinyl acetal (polyvinyl butyral) (product name: S-LEC BX-1 manufactured by Sekisui Chemical Co., Ltd.) in 100 parts of cyclohexanone. The mixture was then dispersed with a sand mill that uses glass beads having a diameter of 1 mm at 23±3° C. for 1 hour. After that, 100 parts of ethyl acetate was added thereto and thus a charge-generating-layer coating solution was prepared. The charge-generating-layer coating solution was stored in an environment of 40° C. for 1 month. After that, the charge-generating-layer coating solution was applied onto the intermediate layer by dip coating, and the resultant layer was dried at 90° C. for 10 minutes to form a charge generating layer having a thickness of 0.21 μm.

transporting-layer coating solution. The charge-transporting-layer coating solution, which was left for one day after the solution became homogeneous, was applied onto the charge generating layer by dip coating, and the resultant layer was dried at 110° C. for 60 minutes to form a charge transporting layer (first charge transporting layer) having a thickness of 18 μm.

(B)

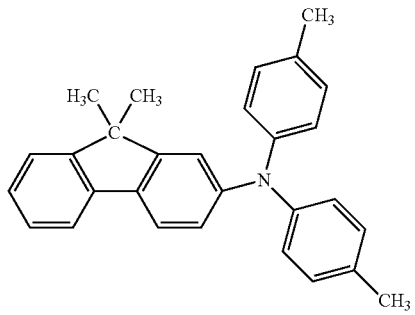

(C)

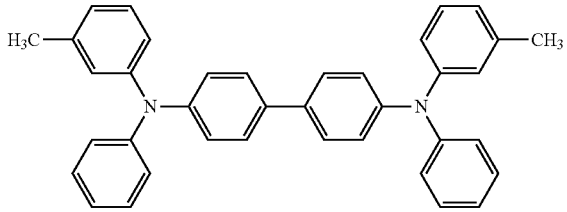

(A)

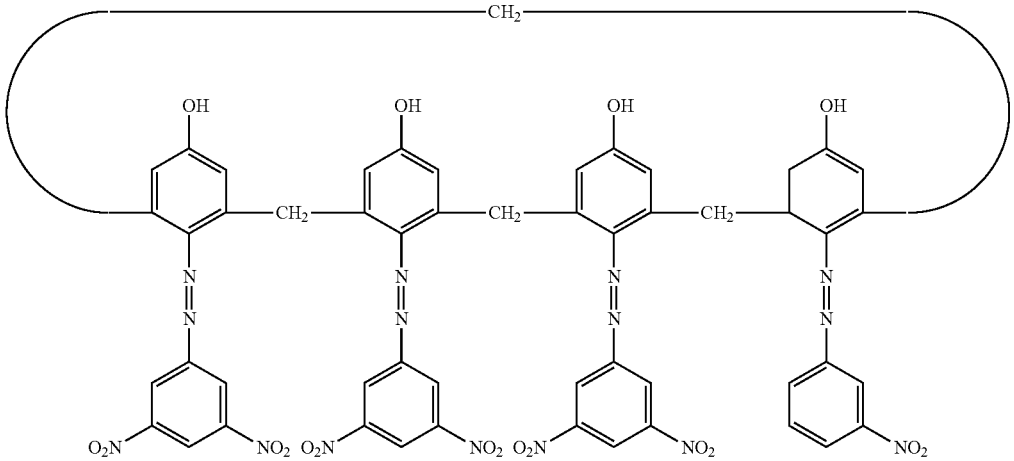

Next, 50 parts of an amine compound (charge transporting substance) represented by the structural formula (B) below, 50 parts of an amine compound (charge transporting substance) represented by the structural formula (C) below, and 100 parts of polycarbonate (product name: Iupilon Z400 manufactured by MITSUBISHI GAS CHEMICAL Company, Inc.) were dissolved in a mixed solvent of 650 parts of chlorobenzene and 150 parts of methylol to prepare a charge- Next, 45 parts of a compound (a charge transporting substance (hole transportable compound) having an acrylic group, which is a chain-polymerizable functional group) represented by the structural formula (D) below and 55 parts of n-propanol were mixed and dispersed with an ultra-high pressure disperser to prepare a surface layer (second-charge-transporting-layer) coating solution.

(D)

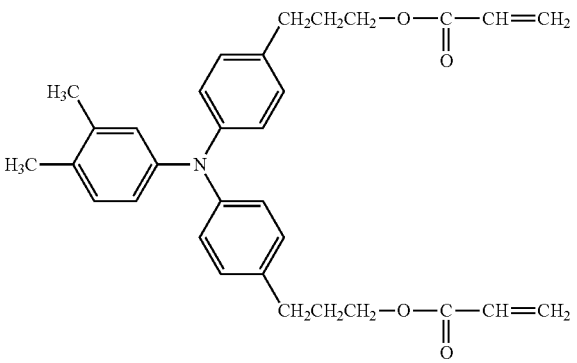

The surface layer (second-charge-transporting-layer) coating solution was applied onto the first charge transporting layer by dip coating, and the resultant layer was dried at 50° C. for 5 minuses. The dried layer was then irradiated with an electron beam at an acceleration voltage of 70 kV at an absorbed dose of 8000 Gy and thus cured. The layer was subjected to heat treatment for 3 minutes under the conditions that the temperature of the layer reached 120° C. The oxygen concentration from the irradiation with an electron beam to the completion of the 3-minute heat treatment was 20 ppm. Subsequently, the layer was subjected to heat treatment in the air for 30 minutes under the conditions that the temperature of the layer reached 100° C., whereby a surface layer (second charge transporting layer) having a thickness of 5 μm was formed.

Accordingly, an electrophotographic photosensitive member including the support, the conductive layer, the intermediate layer, the charge generating layer, the charge transporting layer (first, charge transporting layer), and the surface layer (second charge transporting layer) was produced.

Examples 2 to 16

Electrophotographic photosensitive members were produced in the same manner as in Example 1, except that the types and amounts of the charge generating substance, polyvinyl acetal, and the compound represented by the general formula (1) used for preparing the charge-generating-layer coating solution of Example 1 were changed to those shown in Table 1.

Example 17

An electrophotographic photosensitive member was produced in the same manner as in Example 2, except that the charge generating layer was formed as described below.

That is, 4 parts of an oxytitanium phthalocyanine crystal (charge generating substance) having strong peaks at Bragg angles 2θ±0.2° of 9.0°, 14.2°, 23.9°, and 27.1° in the X-ray diffraction spectrum measured using a CuKα characteristic X-ray and 0.004 parts of the compound (0.1% by mass relative to the charge generating substance) represented by the structural formula (1-1) were added to a solution obtained by dissolving 2 parts of polyvinyl acetal (polyvinyl butyral) (product name: S-LEC BX-1 manufactured by Sekisui Chemical Co., Ltd.) in 100 parts of cyclohexanone. The mixture was then dispersed with a sand mill that uses glass beads having a diameter of 1 mm at 23±3° C. for 4 hours. After that, 100 parts of ethyl acetate was added thereto and thus a charge-generating-layer coating solution was prepared. The charge-generating-layer coating solution was stored in an environment of 40° C. for 1 month. After that, the charge-generating-layer coating solution was applied onto the intermediate layer by dip coating, and the resultant layer was dried at 60° C. for 10 minutes to form a charge generating layer having a thickness of 0.17 μm.

Example 18

An electrophotographic photosensitive member was produced in the same manner as in Example 17, except that the compound represented by the structural formula (1-1) was changed to the compound represented by the structural formula (1-2),

TABLE 1

| | Charge generating substance | | | Fluorenone derivative | | |
|---|---|---|---|---|---|---|
| | Type | Amount used (part) | Polyvinyl acetal Type | Type | Amount used (part) | Relative to charge generating substance [% by mass] |
| Ex. 1 | Hydroxygallium | 4 | S-LEC BX-1 | (1-1) | 0.004 | 0.1 |
| Ex. 2 | phthalocyanine | | | | 0.04 | 1 |
| Ex. 3 | | | | | 0.2 | 5 |
| Ex. 4 | | | | | 0.4 | 10 |
| Ex. 5 | | | | | 0.8 | 20 |
| Ex. 6 | | | | | 0.002 | 0.05 |
| Ex. 7 | | | | | 1 | 25 |
| Ex. 8 | | | | (1-2) | 0.004 | 0.1 |
| Ex. 9 | | | | | 0.04 | 1 |
| Ex. 10 | | | | | 0.2 | 5 |
| Ex. 11 | | | | | 0.4 | 10 |
| Ex. 12 | | | | | 0.8 | 20 |
| Ex. 13 | | | | | 0.002 | 0.05 |
| Ex. 14 | | | | | 1 | 25 |
| Ex. 15 | | | S-LEC BM-1 | (1-1) | 0.08 | 2 |
| Ex. 16 | | | S-LEC BM-S | (1-2) | 0.08 | 2 |
| Ex. 17 | Oxytitanium | | S-LEC BX-1 | (1-1) | 0.04 | 1 |
| Ex. 18 | phthalocyanine | | | (1-2) | 0.04 | 1 |
| C.E. 1 | Hydroxygallium | | | (E-1) | 0.012 | 0.3 |

TABLE 1-continued

| | Charge generating substance | | Polyvinyl acetal | Fluorenone derivative | | |
|---|---|---|---|---|---|---|
| | Type | Amount used (part) | Type | Type | Amount used (part) | Relative to charge generating substance [% by mass] |
| C.E. 2 | phthalocyanine | | | | 0.8 | 20 |
| C.E. 3 | | | | (E-2) | 0.012 | 0.3 |
| C.E. 4 | | | | | 0.8 | 20 |

Ex: Example
C.E.: Comparative Example

In Table 1, "S-LEC BM-1" is polyvinyl acetal (polyvinyl butyral) (product name: S-LEC BM-1) manufactured by Sekisui Chemical Co., Ltd. and "S-LEC BM-S" is polyvinyl acetal (polyvinyl butyral) (product name: S-LEC BM-S) manufactured by Sekisui Chemical Co., Ltd.

Comparative Example 1

An electrophotographic photosensitive member was produced in the same manner as in Example 1, except that 0.004 parts of the compound represented by the structural formula (1-1) was changed to 0.012 parts of the compound (0.3% by mass relative to the charge generating substance) represented by the structural formula (E-1) below.

(E-1)

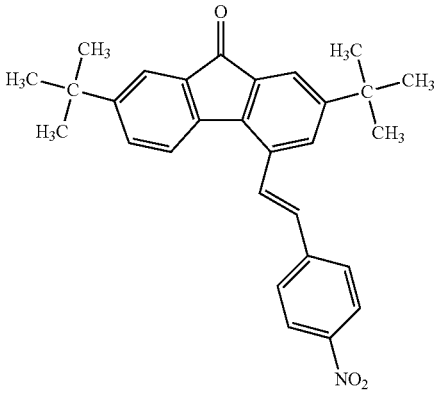

Comparative Example 2

An electrophotographic photosensitive member was produced in the same manner as in Comparative Example 1, except that 0.012 parts of the compound represented by the structural formula (E-1) above was changed to 0.8 parts of the compound represented by the structural formula (E-1) above.

Comparative Example 3

An electrophotographic photosensitive member was produced in the same manner as in Example 1, except that 0.004 parts of the compound represented by the structural formula (1-1) was changed to 0.012 parts of the compound (0.3% by mass relative to the charge generating substance) represented by the structural formula (E-2) below.

(E-2)

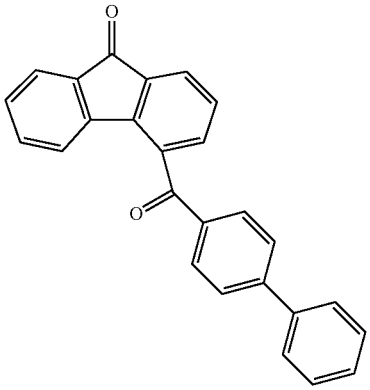

Comparative Example 4

An electrophotographic photosensitive member was produced in the same manner as in Comparative Example 3, except that 0.012 parts of the compound represented by the structural formula (E-2) above was changed to 0.8 parts of the compound represented by the structural formula (E-2) above, Evaluation An evaluation method of the electrophotographic photosensitive members according to Examples 1 to 18 and Comparative Examples 1 to 4 is described below.

<Potential Variation>

A copying machine (product name: GP405 manufactured by CANON YABUSHI KAISHA, processing speed: 210 mm/s, (primary) charging unit: a rubber roller contact charger (charging roller) that uses a current obtained by superimposing an alternating current on a direct current, exposing unit: an image exposing unit with a laser, developing unit: a non-contact developing system that uses single-component magnetic negative toner, transferring unit: a roller-type contact transferring system, cleaning unit: a cleaner in which a rubber blade is disposed in a counter direction, and pre-exposing unit: a pre-exposing unit that use a fuse lamp) was used as an evaluation apparatus. The electrophotographic photosensitive members according to Examples 1 to 18 and Comparative Examples 1 to 4 were each installed in the evaluation apparatus.

The evaluation apparatus was installed in an environment, or 23° C. and 5% RH. The alternating component, of a charging roller was set to be 1500 Vpp and 1500 Hz; and an initial dark potential (Vda) before a long-term durability test obtained when the direct component was set to be −850 V and an initial, light potential (Vla) before a long-term durability test obtained through irradiation with a 780-nanometer laser were adjusted to be −200 V in each of the electrophotographic photosensitive members.

The surface potential of the electrophotographic photosensitive member was measured by removing a developing cartridge from the evaluation apparatus and inserting a potential measurement device therein. The potential measurement device includes a potential measurement probe disposed at a position corresponding to a development position of the developing cartridge. The potential measurement probe was provided in the center of the drum-shaped electrophotographic photosensitive member in the axial direction while being 3 mm away from the surface of the electrophotographic photosensitive member.

Evaluations were conducted in accordance with (1) and (2) below. Herein, the evaluations of (1) and (2) below were conducted without changing the initial conditions of the alternating component/direct component and the initial exposure conditions for the electrophotographic photosensitive member. The evaluations were conducted after the electrophotographic photosensitive member was left to stand in an environment of 23° C. and 5% RE for 48 hours to adapt the electrophotographic photosensitive member to the environment.

(1) The electrophotographic photosensitive member and the potential measurement device were installed in the evaluation apparatus, and a short-term durability test equivalent to the printing of 999 sheets was performed prior to a long-term durability test without passing sheets to measure a dark potential (Vdb) at the time the printing equivalent to the 999th sheet was performed before a long-term durability test and a light, potential (Vlb) at the time the printing equivalent to the 999th sheet was performed before a long-term durability test. The differences between the initial dark potential (Vda) and the dark potential (Vdb) at the time the printing equivalent to the 999th sheet was performed before a long-term durability test and between the initial light potential (Vla) and the light potential (Vlb) at the time the printing equivalent to the 999th sheet was performed before a long-term durability test were confirmed. The differences were respectively referred to as ΔVd(ab) before a long-term durability test and ΔVl(ab) before a long-term durability test.

(Initial dark potential (Vda) before long-term durability test)−(dark potential (Vdb) at the time the printing equivalent to the 999th sheet was performed before long-term durability test)=ΔVd(ab) before long-term durability test (Initial light potential (Vla) before long-term durability test)−(light potential (Vlb) at the time the printing equivalent to the 999th sheet was performed before long-term durability test)=ΔVl(ab) before long-term durability test (2) Subsequently, the potential measurement device was removed and the developing cartridge was installed, and a 50000-sheet long-term durability test was performed with passing sheets. After the completion of the long-term durability test, the evaluation apparatus was left to stand in the same environment of 23° C. and 5% RH for 24 hours. After that, the developing cartridge was removed and the potential measurement device was installed. A short-term durability test equivalent to the printing of 999 sheets after the long-term durability test was performed in the same manner as in (1) without passing sheets. In this short-term durability test, the differences between the initial dark potential (Vdc) after a long-term durability test and the dark potential (Vdd) at the time the printing equivalent to the 999th sheet was performed after a long-term durability test and between the initial light potential (Vlc) after a long-term durability test and the light potential (Vld) at the time the printing equivalent, to the 999th sheet was performed after a long-term durability test were confirmed. The differences were respectively referred to as ΔVd(cd) after a long-term durability test and ΔVl(cd) after a long-term durability test.

(Initial dark potential (Vdc) after long-term durability test)−(dark potential (Vdd) at the time the printing equivalent to the 999th sheet was performed after long-term durability test)=ΔVd(cd) after long-term durability test (Initial, light potential (Vlc) after long-term durability test)−(light potential (Vld) at the time the printing equivalent to the 999th sheet was performed after long-term durability test)=ΔVl(cd) after long-term durability test The 50000-sheet durability test (long-term durability test) was performed using A4 paper at a printing percentage of 6% in an intermittent mode (8 seconds per sheet) in which printing is stopped once a single sheet.

Table 2 shows the evaluation results.

<Black Spots>

A copying machine (product name: GP405 manufactured by CANON KABUSHIKI KAISHA, processing speed: 210 mm/s, (primary) charging unit: a rubber roller contact charger (charging roller) that uses a current obtained by superimposing an alternating current on a direct current, exposing unit: an image exposing unit with a laser, developing unit: a non-contact developing system that uses single-component magnetic negative toner, transferring unit: a roller-type contact transferring system, cleaning unit: a cleaner in which a rubber blade is disposed in a counter direction, and pre-exposing unit: a pre-exposing unit that use a fuse lamp) was used as an evaluation apparatus. The electrophotographic photosensitive members according to Examples 1 to 18 and Comparative Examples 1 to 4 were each installed in the evaluation apparatus.

The evaluation apparatus was installed in an environment of 32° C. and 85% RH. The alternating component of a charging roller was set to be 1500 Vpp and 1500 Hz; the dark potential was adjusted no be −800 V in each of the electrophotographic photosensitive members; and the light potential obtained through irradiation with a 780-nanometer laser was adjusted to be −200 V in each of the electrophotographic photosensitive members.

The surface potential of the electrophotographic photosensitive member was measured by removing a developing cartridge from the evaluation apparatus and inserting a potential measurement device therein. The potential measurement device includes a potential measurement probe disposed at a position corresponding to a development position of the developing cartridge. The potential measurement probe was provided in the center of the drum-shaped electrophotographic photosensitive member in the axial direction while being 3 mm away from the surface of the electrophotographic photosensitive member.

After the dark potential and the light potential were adjusted to be the above-described potentials, the potential measurement device was removed from the evaluation apparatus and the developing cartridge was inserted therein. The potential of the developing cartridge was set to be −700 V. A solid black image was output on five sheets and then a solid white image was output on one sheet. Black, spots were evaluated by observing the solid white image through visual inspection. The criteria of the evaluation is as follows. Table 2 shows the evaluation results.

A: No black spots are formed.

B: Black spots are slightly formed.

C: Black spots are obviously formed.

TABLE 2

| | Before long-term durability test | | After long-term durability test | | | | |
|---|---|---|---|---|---|---|---|
| | ΔVd(ab) [V] | ΔVl(ab) [V] | Vdc [V] | Vlc [V] | ΔVd(cd) [V] | ΔVl(cd) [V] | Black spots |
| Ex. 1 | −10 | +10 | 840 | 220 | −20 | +25 | A |
| Ex. 2 | −10 | +10 | 840 | 220 | −20 | +25 | A |
| Ex. 3 | −10 | +10 | 840 | 220 | −20 | +25 | A |
| Ex. 4 | −10 | +10 | 840 | 220 | −20 | +25 | A |
| Ex. 5 | −10 | +10 | 840 | 220 | −20 | +25 | A |
| Ex. 6 | −10 | +10 | 840 | 220 | −20 | +30 | A |
| Ex. 7 | −10 | +10 | 840 | 220 | −20 | +25 | B |
| Ex. 8 | −10 | +10 | 840 | 220 | −20 | +25 | A |
| Ex. 9 | −10 | +10 | 840 | 225 | −20 | +25 | A |
| Ex. 10 | −10 | +10 | 840 | 225 | −20 | +25 | A |
| Ex. 11 | −10 | +10 | 840 | 225 | −20 | +25 | A |
| Ex. 12 | −10 | +10 | 840 | 225 | −20 | +25 | A |
| Ex. 13 | −10 | +10 | 840 | 225 | −20 | +30 | A |
| Ex. 14 | −10 | +10 | 840 | 225 | −20 | +25 | B |
| Ex. 15 | −10 | +10 | 840 | 225 | −20 | +25 | A |
| Ex. 16 | −10 | +10 | 840 | 225 | −20 | +25 | A |
| Ex. 17 | −10 | +15 | 840 | 225 | −20 | +30 | A |
| Ex. 18 | −10 | +15 | 840 | 220 | −20 | +30 | A |
| C.E. 1 | −15 | +15 | 830 | 280 | −25 | +50 | B |
| C.E. 2 | −15 | +15 | 830 | 250 | −25 | +45 | C |
| C.E. 3 | −15 | +15 | 830 | 270 | −30 | +55 | B |
| C.E. 4 | −15 | +15 | 830 | 240 | −25 | +45 | C |

Ex: Example
C.E.: Comparative Example

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-247863 filed Nov. 4, 2010 and No. 2011-227037 filed Oct. 14, 2011, which are hereby incorporated by reference herein in their entirety.

What is claimed is:

1. An electrophotographic photosensitive member comprising:

a support; and a charge generating layer and a charge transporting layer formed on the support, wherein the charge generating layer comprises:

a charge generating substance, polyvinyl acetal, and a compound represented by the structural formulae (1-1), (1-3) or (1-4) below:

(1-1)

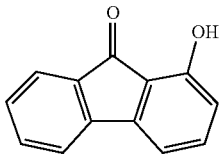

(1-3)

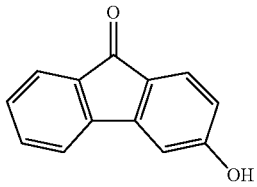

-continued (1-4)

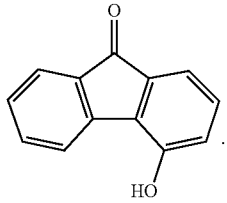

2. The electrophotographic photosensitive member according to claim 1, wherein the charge generating layer comprises the compound represented by the structural formulae (1-1), (1-3), or (1-4) in an amount of 0.1% or more and 20% or less by mass relative to the amount of the charge generating substance.

3. The electrophotographic photosensitive member according to claim 1, wherein the charge generating substance is a phthalocyanine pigment.

4. A method for producing an electrophotographic photosensitive member comprising:

a support; and a charge generating layer and a charge transporting layer formed on the support, wherein the method comprises a step of forming the charge generating layer with a charge-generating-layer coating solution comprising:

a charge generating substance, polyvinyl acetal, and a compound represented by the structural formulae (1-1), (1-3) or (1-4) below:

(1-1)

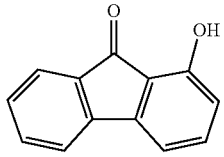

(1-3)

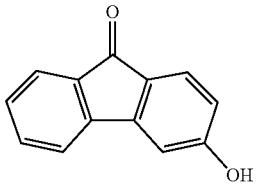

(1-4)

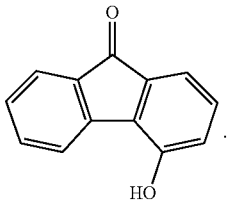

5. The method according to claim 4, wherein the charge-generating-layer coating solution comprises the compound represented by the structural formulae (1-1), (1-3), or (1-4) in an amount of 0.1% or more and 20% or less by mass relative to the amount of the charge generating substance.

6. The method according to claim 4, wherein the charge generating substance is a phthalocyanine pigment.

7. A process cartridge detachably mountable to a main body of an electrophotographic apparatus, the process cartridge comprising:

the electrophotographic photosensitive member according to claim 1; and at least one unit selected from the group consisting of a charging unit, a developing unit, a transferring unit, and a cleaning unit, wherein the process cartridge integrally supports the electrophotographic photosensitive member and the at least one unit.

8. An electrophotographic apparatus comprising:

the electrophotographic photosensitive member according to claim 1;

a charging unit;

an exposing unit;

a developing unit; and a transferring unit.

* * * * *